US006199576B1

(12) United States Patent
Young

(10) Patent No.: US 6,199,576 B1
(45) Date of Patent: Mar. 13, 2001

(54) BI-DIRECTIONAL CLEANOUT WITH BACKFLOW PREVENTER

(76) Inventor: Randy E. Young, 74 W. 50 South, Blackfoot, ID (US) 83221

( * ) Notice: Subject to any disclaimer, the term of this patent is extended or adjusted under 35 U.S.C. 154(b) by 0 days.

(21) Appl. No.: 09/427,866

(22) Filed: Oct. 26, 1999

(51) Int. Cl.[7] ..... F16K 43/00; B08B 9/04

(52) U.S. Cl. ..... 137/242; 15/104.31; 4/DIG. 7; 137/244; 137/315.33; 137/357; 137/527.8

(58) Field of Search ..... 15/104.31, 104.33; 4/255.01, 256.1, DIG. 7; 137/15.18, 236.1, 242, 244, 245, 315.33, 357, 358, 360, 527.8

(56) References Cited

U.S. PATENT DOCUMENTS

| | | | | |
|---|---|---|---|---|
| 623,585 | * | 4/1899 | Waring | 15/104.31 |
| 914,824 | * | 3/1909 | Greenan | 15/104.31 |
| 2,322,508 | * | 6/1943 | Crane | 15/104.31 |
| 3,160,904 | * | 12/1964 | Swanson | 15/104.31 |
| 3,726,306 | | 4/1973 | Purvis | 137/375 |
| 3,852,836 | | 12/1974 | Oberholtzer | 4/DIG. 7 |
| 3,955,596 | * | 5/1976 | Diaz | 137/527.8 |
| 4,215,724 | | 8/1980 | Logsdon | 137/852 |
| 4,388,741 | | 6/1983 | Breon | 15/104.33 |
| 4,508,139 | | 4/1985 | Teumer | 137/315.33 |
| 4,762,666 | | 8/1988 | Chang et al. | 376/264 |
| 4,974,280 | * | 12/1990 | Ward | 15/104.31 |
| 5,123,627 | | 6/1992 | Hodges | 251/146 |
| 5,209,257 | | 5/1993 | Baker, Jr. | 137/357 |
| 5,234,018 | * | 8/1993 | Grachal et al. | 137/244 |
| 5,244,505 | | 9/1993 | Allison et al. | 15/104.31 |
| 5,285,816 | | 2/1994 | Herlihy | 137/527.8 |
| 5,467,640 | | 11/1995 | Salinas | 73/49.1 |
| 5,651,147 | | 7/1997 | Steele et al. | 4/255.01 |
| 5,740,830 | * | 4/1998 | Mankins | 137/318 |
| 5,826,609 | * | 10/1998 | Watts | 137/527.8 |
| 6,029,684 | * | 2/2000 | Watts | 137/527.8 |

* cited by examiner

*Primary Examiner*—George L. Walton
(74) *Attorney, Agent, or Firm*—Robert L. Shaver; Frank J. Dykas

(57) ABSTRACT

The invention is a bi-directional cleanout for pipelines such as sewer pipelines and a bi-directional cleanout with a built in backflow preventer. The backflow preventer is a check valve which allows fluid to flow in one direction, but not in the other direction. The bi-directional cleanout is a device which has a single access point at ground level, is located outside a house typically, and which directs a cleanout tool down one of two tool guide tubes. The guide tubes direct the cleanout tool into one of two tool guides which deflect the cleanout tool and cause it to enter the pipeline to be cleaned in a direction towards one or the other of the ends. The check valve is insertable into the pipe level unit in which the tool guides are located. While the pipeline is being cleaned out with the cleanout tool, the check valve can be removed and reinserted after the cleanout procedure is completed.

15 Claims, 12 Drawing Sheets

BI-DIRECTIONAL CLEANOUT WITH BACKFLOW PREVENTER

BACKGROUND OF THE INVENTION

1. Field of the Invention

The present invention generally relates to backflow preventers and sewer cleanouts, and more specifically to sewer line backflow preventers and cleanouts.

2. Background Information

Houses in modern residential areas are connected to municipal sewer lines by underground sewer pipes. If a house has a basement, the sewer lines are typically at a depth that the sewer line can go through the floor of the basement and under the basement walls. It is currently required that every such municipal sewer line connection to a house include a backflow preventer and an access for cleaning out the sewer line. The cleanout access is typically in the form of a Y, called a sanitary T, with an extension which reaches the ground level, and containing a plug which may be removed to allow clean out. The purpose of the cleanout is to allow periodic cleaning of the sewer lines from the house to the main sewer line.

Somewhere in the line, typically inside the house under the backflow preventer is a flap which allows fluid to flow in only one direction. When fluid flows from the opposite direction, the flap seals against a seat, preventing fluid from passing through the flap. The purpose of the backflow preventer is to keep sewage from backing up into the house in the event of a blockage of the municipal sewer line. Once the backflow preventer is installed, subsequent remodeling of the house can result in the backflow preventer being buried in a wall, covered by flooring, or the home owner may not know where it is. Locating the backflow preventer may be difficult, if not impossible, when it is necessary to clean the sewer line. In order to clean the sewer line between inside the house and the outside cleanout, it is necessary for a service person to enter the house with equipment, possibly soiling carpets and creating a mess where he is working, disrupting the household and requiring that some one be at home when the service is performed.

The backflow preventer is installed in a different location than the cleanout, and the cleaning tool must pass through it to clean from inside the house to the cleanout outside the house. The cleaning tool typically has rotating blades which scrape the sides of the sewer pipe. The rotating blades are extended into the sewer line by a cable. When the cleanout tool passes through the backflow preventer, it passes through in one direction without any problems. However, when the cleanout tool must be withdrawn from the line, it can snag on the backflow preventer, damaging or destroying the flap, or wearing a groove in one side of the backflow preventer which prohibits the backflow preventer from sealing against the flow of liquid. When the sewage line has a blockage, sewage will back up into every house in which the backflow preventer is not functioning properly, resulting in flooded basements and damaged or ruined walls, carpets, furniture and other household possessions. The municipality typically pays for these damages.

What is needed is a system that accomplishes the task of a backflow preventer, but allows a cleaning tool to pass through it without damaging it. Also needed is a method to allow access to sewer lines outside the house and permit cleaning of the all sewer lines both inside the house and outside.

Accordingly, it is the object of the present invention to provide a backflow preventer that can be cleaned out by a sewer line cleaning tool and not be damaged by passage of the cleanout tool. It is a further object to provide a sewer line cleanout access available at ground level outside of a house, and provide a bidirectional cleanout which allows the sewer line to be cleaned in two directions, toward the house and toward the municipal sewer line. This cleanout is to clean the entire line with no "dead" spots which are inaccessible to the sewer cleaning tool.

It is a further object to provide a backflow check valve that is replaceable and serviceable from ground level outside the house without digging, even though the backflow check valve may be located many feet under the ground.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

These and other objects are accomplished by a pipeline backflow check valve and bi-directional cleanout which is installed and used in a sewer pipeline. The basic unit is a bi-directional cleanout for directing a cleanout tool towards either end of a pipeline in which one end of the pipeline is toward the house, and the other is toward the municipal sewer line. The bi-directional cleanout allows the line cleaning with no dead spots in the line.

The bi-directional cleanout unit includes a generally tubular first guide tube, which extends from grade level to attachment to a pipe level unit. The first guide tube serves to guide a cleanout tool into the pipeline in a direction towards the first end of the pipeline.

The bi-directional cleanout unit also includes a generally tubular second guide tube, which extends from grade level to attachment to a pipe level unit. The second guide tube serves to guide a cleanout tool into the pipeline in a direction towards the second end of the pipeline.

Also included in the invention is a pipe level unit. The pipe level unit is a fitting in which the two tool-guiding channels are brought together. The pipeline level unit includes a first direction tool guide, which attaches at one end to the first guide tube, and which directs the cleanout tool into the pipeline towards the first end of the pipeline. The pipeline level unit includes a second direction tool guide, which attaches at one end to the second guide tube, and which directs the cleanout tool into the pipeline towards the second end of the pipeline. The tool guides direct the cleanout tool along paths which intersect with each other, so that the pipeline can cleaned out without leaving dead spots, uncleaned regions, or areas where the cleanout tool can't reach.

The bi-directional cleanout may include a backflow check valve. The backflow check valve is removable without digging, and serves to allow a flow of fluid in one direction, but prevents flow from the opposite direction. The backflow check valve is a flap which is hinged on one side, and which fits against a check valve seat. The flap open freely in fluid flow from one direction, but fluid flow from the other direction causes the flap of the check valve to shut against the check valve seat, and stop the flow of fluid. The check valve and cleanout unit can also be provided with a means of removing the backflow check valve. The means for removing the check valve can be a separate tube with guide rails, channels, or ridges, inside the tube, which would extend from the position of the pipe level unit, to ground level. The channels, rails or ridges are located inside the check valve access tube and assist in the removal of the check valve to ground level or the installation of the check valve at the sewer pipe level. A rod can be attached to the check valve, and can extend to ground level, to facilitate removing the check valve by lifting the rod up the tube.

The pipeline backflow check valve and bi-directional cleanout can include a ground level unit in which the two guide tubes are brought together, and the means of removing the backflow check valve is also terminated. In this aspect of the invention, guide tube selectors are provided which allow a cleanout tool to be routed to either the first guide tube or the second guide tube. This ground level unit has an access opening and a cap, and provides a single point of access to the two guide tube selectors and the means of backflow check valve access tube. This unit may include a rod for removing the check valve.

The ground level unit, when combined with the pipe level unit, provides a route for directing a sewer cleaning tool into one of the two guide tubes, which will cause the sewer cleaning tool to be directed either toward the municipal sewer line or toward the house. The sewer cleaning tool, when directed down first one and then the other of the two tool guides, cleans the sewer pipe toward the house and then toward the municipal sewer line, and does not leave an uncleaned or inaccessible region of pipe between the two tool guides. This is because the two tool guides direct the sewer cleanout tool towards each other. The two guide tubes will typically be two vertical tubes. These can be a variety of heights, and the depth of the pipe is not a limiting factor.

The two tool guide tubes can also be formed from one tube which has a figure eight cross sectional shape. In this type of figure eight tube, the means for removing the backflow check valve may be grooves or ridges in the housing of the backflow check valve flapper, which seat on the inside corners of the figure eight, and are guided by the figure eight pipe into a seating position in the pipe level unit.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
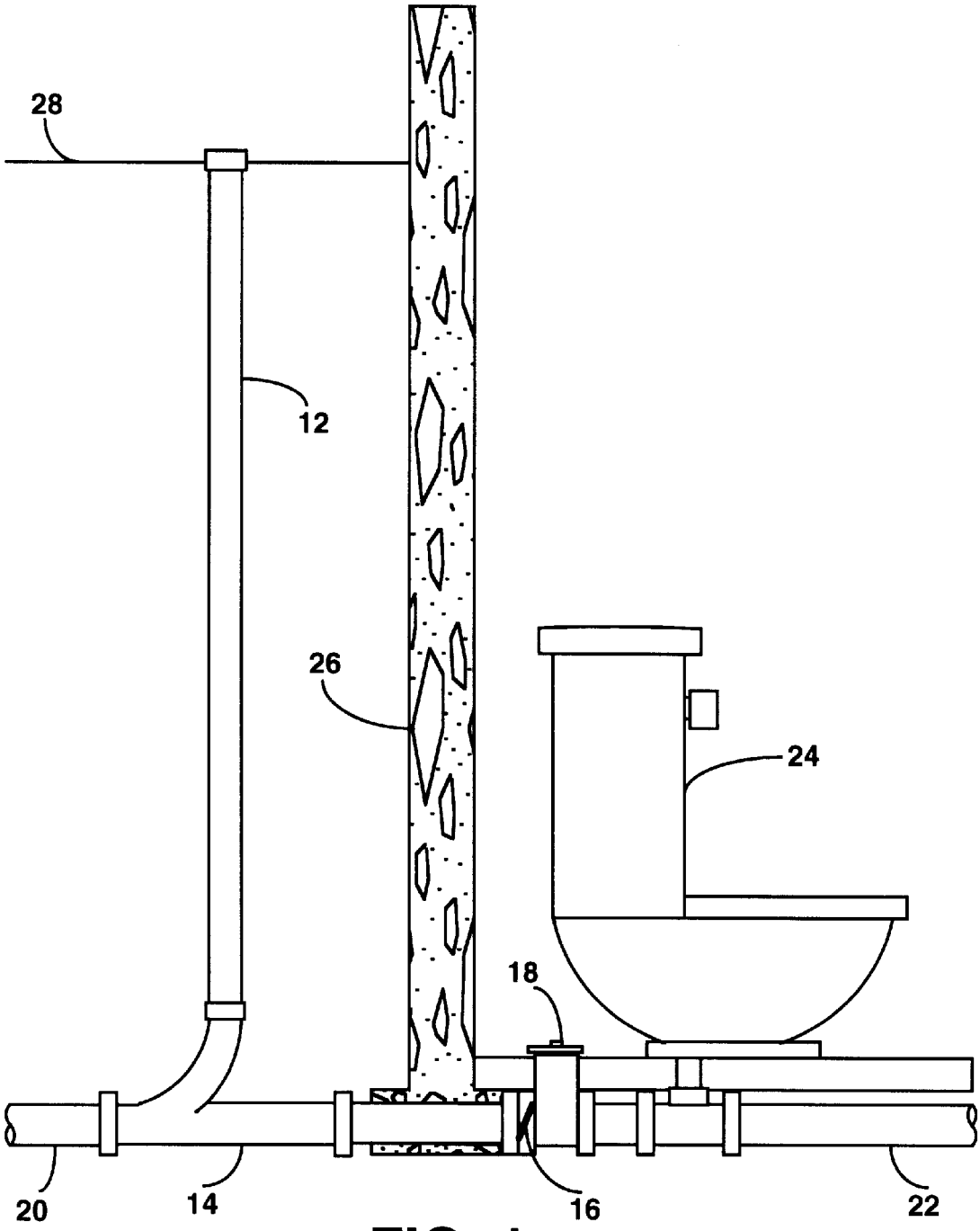
FIG. 1 PRIOR ART
FIG. 1 is a view of a prior art installation of a toilet in a basement, with check valve and cleanout access.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The invention is a bi-directional cleanout unit, for use in a pipeline such as a municipal sewer pipeline which is attached to a house. For purposes of clarity, the city end of the pipeline is called the "first end", and household end of the sewer pipeline is called the "second end" of the pipeline.

FIG. 1 shows a typical household sewer installation using current technology. FIG. 1 shows a toilet 24 which is located inside the basement of a house. The house has a basement wall 26. A connection from the toilet extends into the sewer line to the house 22. Along the sewer line to the house 22 is a check valve 16. The check valve 16 has an access cap 18 through which the check valve can be accessed. The house line 22 goes either through or under the footing of the basement wall 26, and connects to a sanitary T 14. A cleanout 12 connects to the sanitary T 14 and extends to ground level 28. Sanitary T 14 also connects to the sewer line to the city 20. In the current typical installation, some type of a cleanout outside the house is required, and some kind of a check valve is also required. When the sewer line 20 needs to be cleaned out, a cleanout tool can be inserted in the cleanout 12 and extends through the sanitary T 14, and can be directed towards the first, or city end, of the sewer line 20. This leaves all of the sewer lines and fittings from the Y of the sanitary T 14 towards the house unable to be cleaned through the cleanout 12. In order to clean the line to the house 22, a cleanout tool must be inserted either at the check valve 16 through the access cap 18, or by removing the toilet from the floor and inserting the cleanout tool down the toilet connection.

Problems arise because the check valve 16 may be difficult to find, or the access cap 18 may be covered by the floor, located inside a concrete wall, covered by remodeling, or in a location unknown to the occupants of the house. If the check valve 16 cannot be found, access to the house line 22 must be attained by removing the toilet and inserting the cleanout tool through the toilet connection into line 22. This may still leave portions of line 22 uncleaned, and may be unsuccessful if the connection from the toilet to line 22 does not provide a structure for turning the cleanout tool in one direction or the other. If the cleanout tool becomes directed toward the city end of the line, it will eventually go through the check valve 16. Going through the check valve 16 is not difficult in the direction from the house to the city. However, when the cleanout tool is pulled back toward the house, the flap of the check valve 16 may close on the line or cable of the cleanout tool, and may lock it in place. When this happens the flap of the check valve may be destroyed or damaged in the process of withdrawing the cleanout tool. It can also be damaged by having a groove worn along one of its sides, which would result in the check valve not forming a waterproof seal against the check valve seat.

Figure 2:
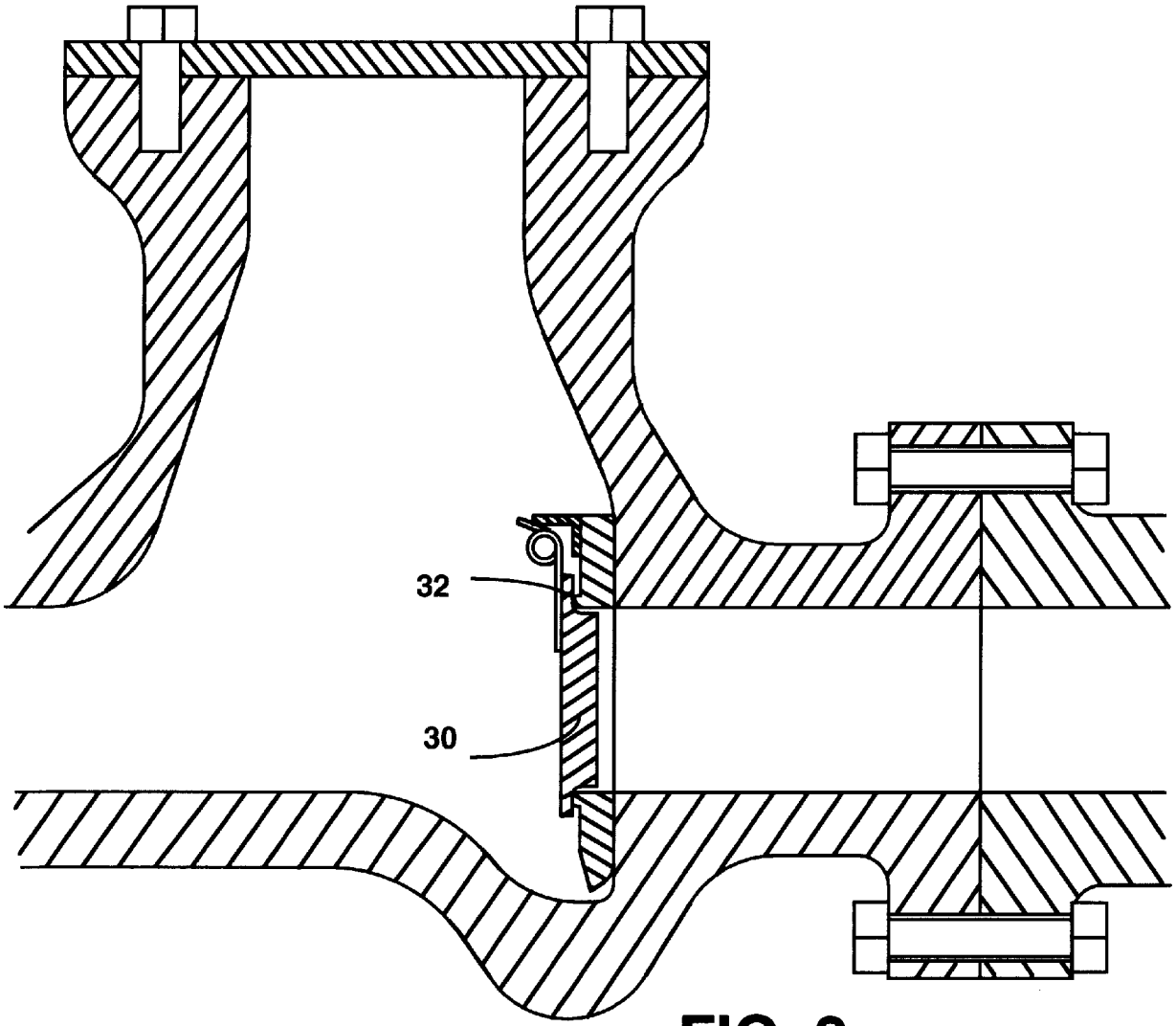
FIG. 2 PRIOR ART
FIG. 2 is a cross-sectional view of a prior art check valve.

FIG. 2 is a drawing of a prior art check valve and shows the check valve 30 and the check valve seat 32.

The problems which the prior art system causes are that the check valve 30 and the check valve 16 may be destroyed or damaged, and the next time a blockage of the city's municipal sewer pipes occurs, sewage may back up in the line to the city 20 and the line to the house 22, and go through the check valve 16. If this were to happen the users would find that their toilet overflowed. When they tried to correct their overflowing toilet by removing the access cap 18 to put a cleanout tool through the check valve 16, the basement would be flooded by sewage from the line to the city 20. Additionally, the workman who is working on the inoperative toilet problem would have to enter the house and carry equipment into the basement to work on the problem. Even if the sewage were not backed up from the city, a workman being in the basement causes problems. Someone must be at home for the workman to enter and while the workman is there. The workman must carry equipment into the house and downstairs, with the potential of soiling carpet or scratching floors, or doing other incidental damage.

Figure 3:
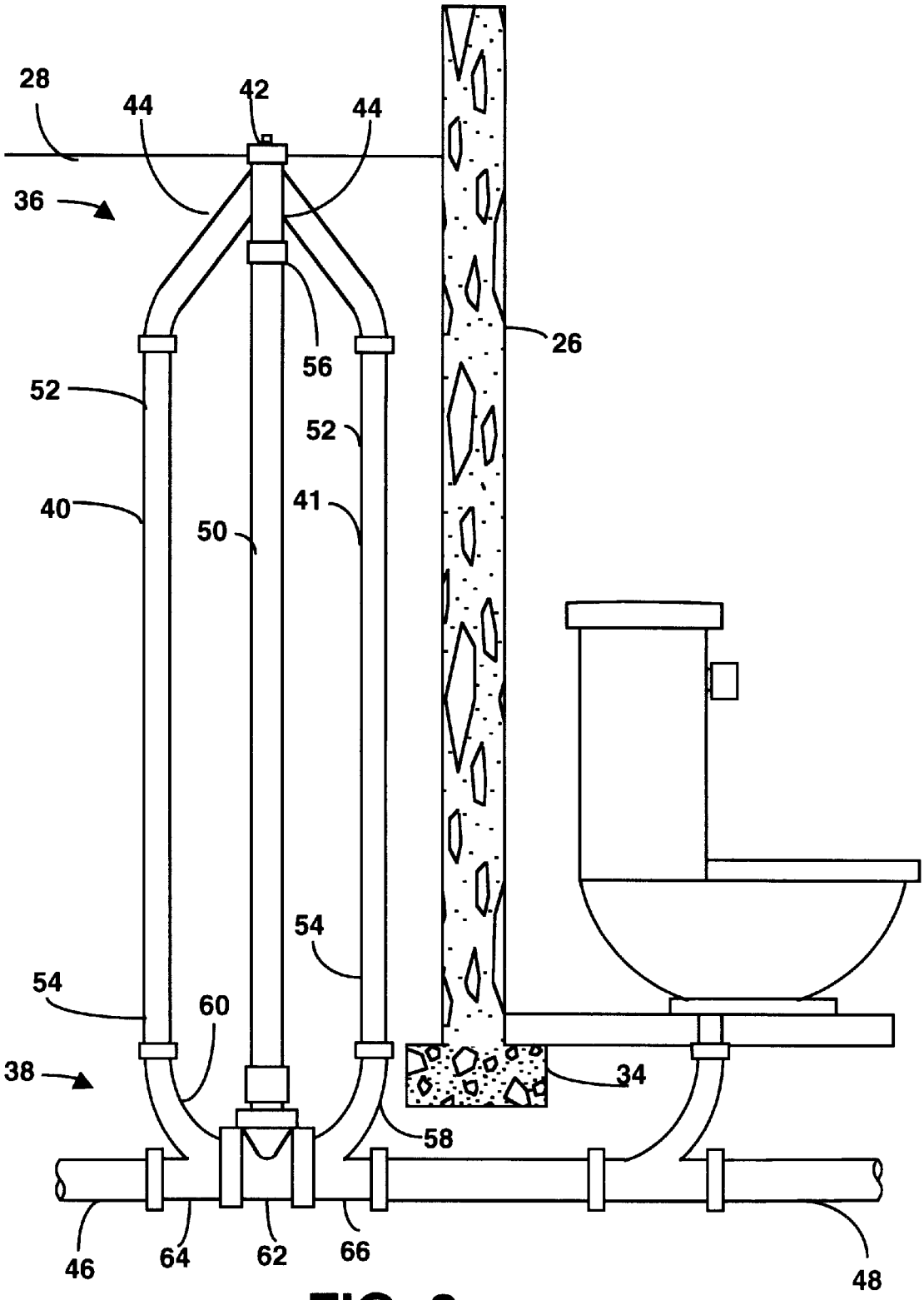
FIG. 3 is a side view of the bi-directional cleanout and backflow check valve of the invention installed to clean out a basement level sewer line.

FIG. 3 shows one preferred embodiment of the invention. This embodiment is a bi-directional cleanout unit with a backflow check valve 10. The bi-directional cleanout with backflow check valve 10 is shown in FIG. 3 replacing the sanitary T of the prior art. It also replaces the check valve 16 which was located inside the house in the prior art installation. The bi-directional cleanout and backflow check valve 10 includes a ground level unit 36 and a pipe level unit 38. The ground level unit 36 has an access opening 42, two (2) guide tube selectors 44, and a check valve access tube connector 56. The ground level unit 36 would preferably be built as one piece, but could also be formed from individual components which are joined together. The ground level unit 36 could be composed of such individual units as two (2) 45° elbows, two (2) straight pipe sections, a three (3)-way pipe connector, and a cap. The ground level unit 36 would preferably be four (4) inches in diameter in all components, but other sizes would be possible and would still be operable. The preferred material for the ground level unit 36 is plastic, either PVC or ABS or any other suitable formulation of plastic. In this embodiment of the invention, the ground level unit 36 is connected to the pipe level unit 38 by three (3) tubular extensions. This are the first guide-tube 40, the second guide-tube 41 and the check valve access tube 50. Each of these three are straight sections of pipe, and therefore could be extended to any required length in order to reach from ground level 28 to the level of the pipe level unit 38. The pipe level unit 38 replaces the sanitary T 14 of the prior art installation. It includes a first direction tool guide 58 and a second direction tool guide 60 which are attached to a pipe section 62. The pipe section 62 has a first end 64 and a second end 66. The first end 64, attaches to the first end (city end) of the sewer pipe 46, and the second end 66 attaches to the second (house end) of the sewer pipe 48.

Figure 4:
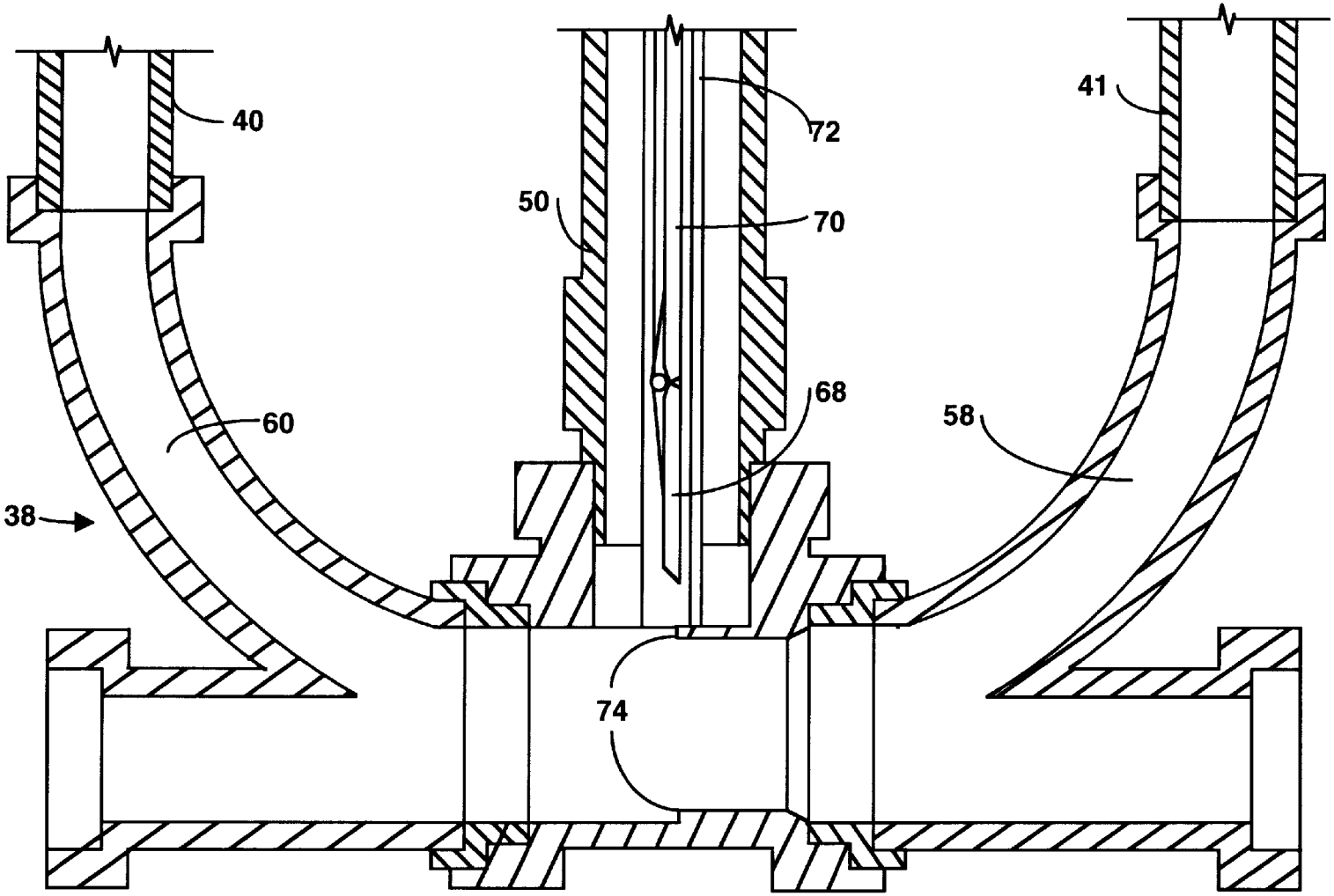
FIG. 4 is a cross-sectional view of the pipe level unit with the check valve withdrawn.
Figure 5:
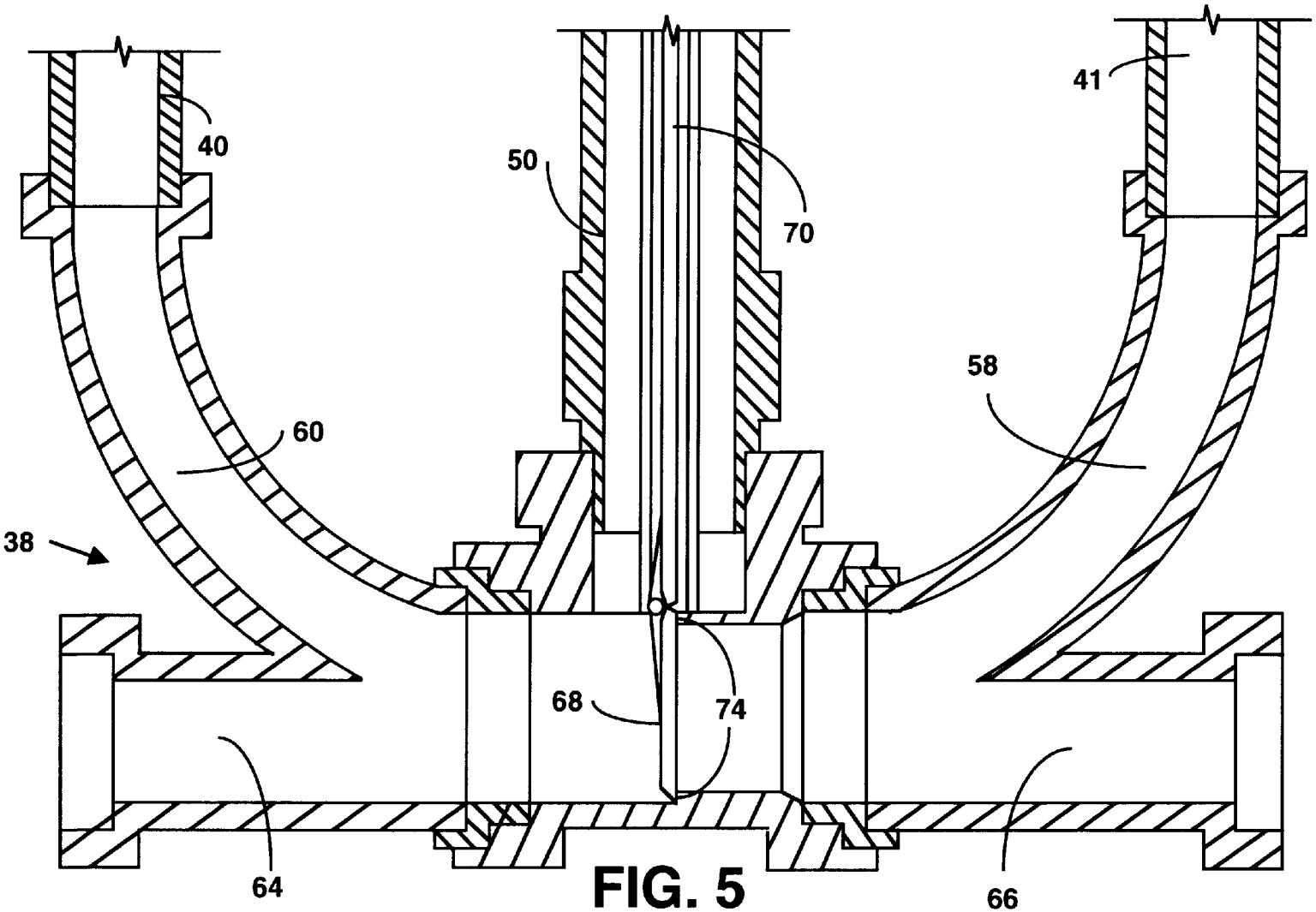
FIG. 5 is a cross-sectional view of the pipe level unit with the check valve installed.
Figure 6:
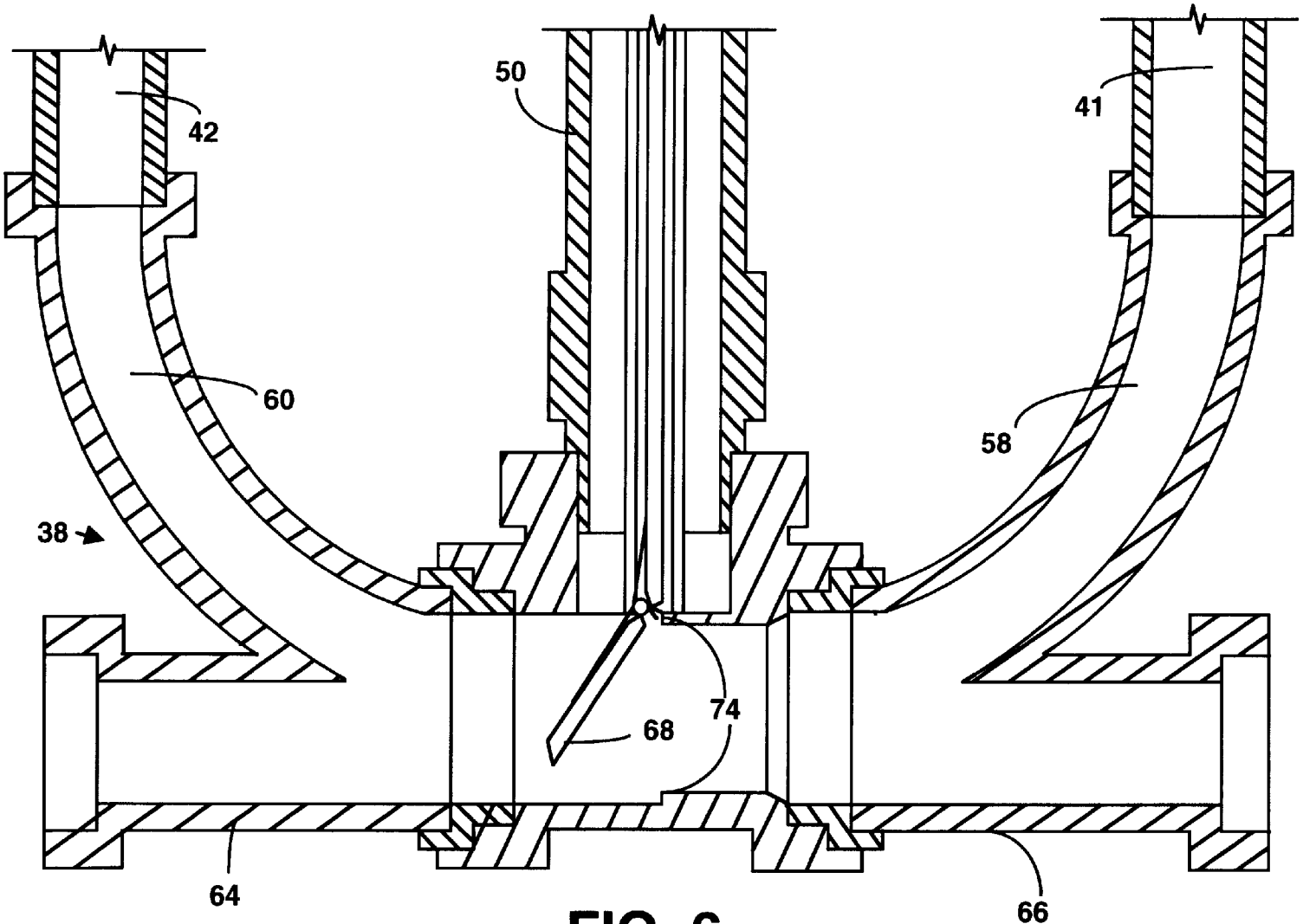
FIG. 6 is a cross-sectional view of the pipe level unit with the check valve installed and opening to allow fluid to flow from right to left.
Figure 12:
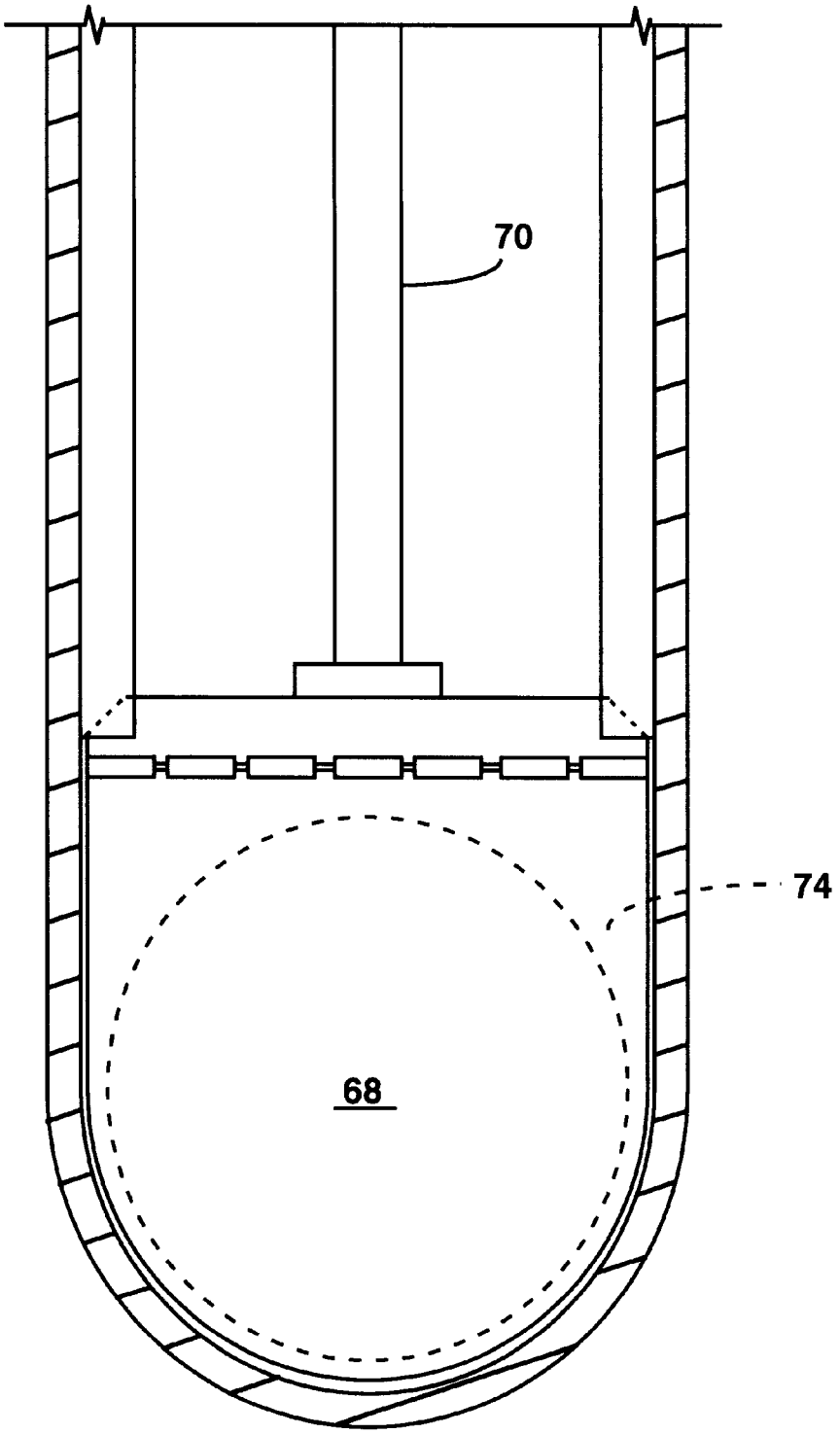
FIG. 12 is a view of the check valve attached to the check valve rod.

FIG. 4 shows a cross-sectional view of the pipe level unit 38. In this view the check valve 68 is shown attached to a check valve rod 70. The check valve 68 can be lowered or raised by the check valve rod 70 and is guided in the check valve access tube 50 by a pair of channels 72 which are located on the inside walls of the check valve access tube 50. Various other means of removing and inserting the check valve 68 can also be used, such as channels, rails, grooves, tracks or any equivalent guiding means. In the illustration shown in FIG. 4, the check valve is in a position which does not obstruct the passage of a cleanout tool through either the first direction tool guide 58 or the second direction tool guide 60. Also shown is the check valve seat 74. FIG. 5 shows a similar view, but shows the check valve fully lowered into a working position so that it seats against check valve seat 74 when fluid flows from left to right in the drawing. A front view of the check valve 68 can be seen in FIG. 12. valve opening when fluid flows from pipe end 66 toward pipe end 64.

Figure 7:
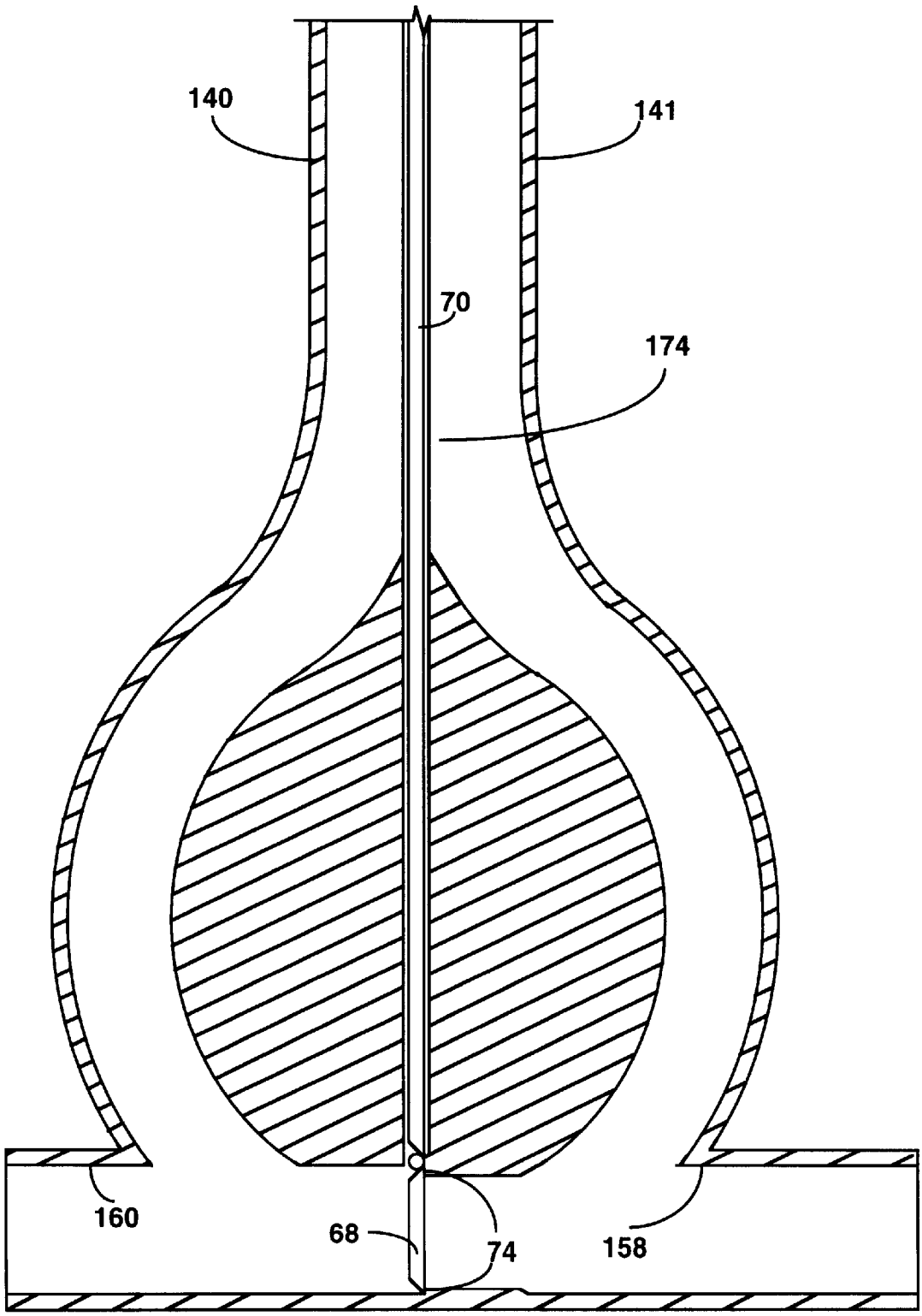
FIG. 7 is a cross-sectional view of one version of the check valve cleanout unit in which the guide tubes are in the form of a figure eight pipe.
Figure 8:
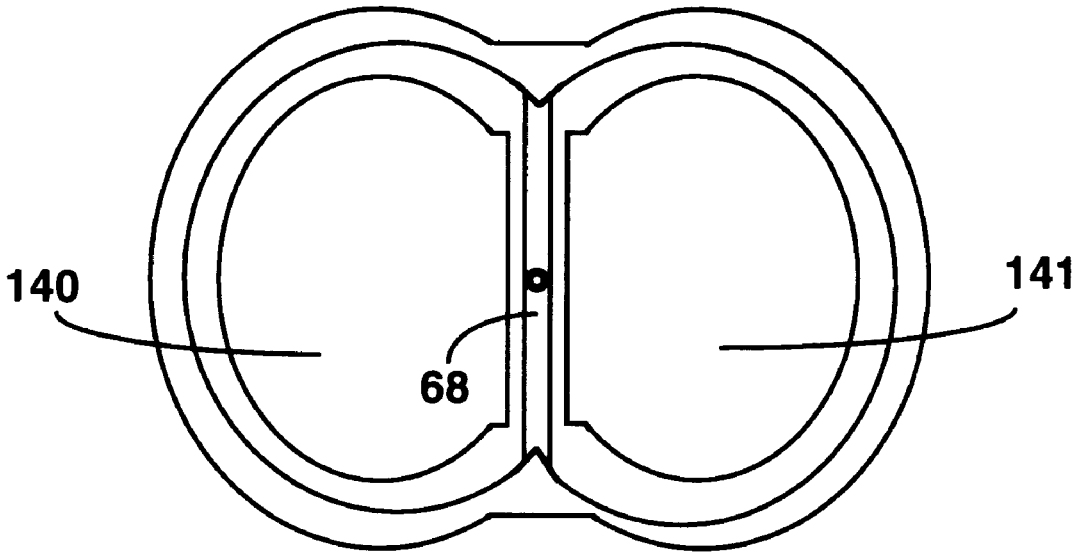
FIG. 8 is a side cross-sectional view of a pipe level unit of the device utilizing a figure eight shaped tube for the tool-guiding channels

FIG. 7 and FIG. 8 show another possible configuration and a different preferred embodiment of the invention.

As shown in FIG. 7 and FIG. 8, the guide tubes 40 and 41 are formed in the shape of a figure eight. FIG. 8 shows there is no check valve access tube, but there is a way that the check valve is lowered and raised into position. The walls of the two components of the figure eight come together and form a ridge where guide tube 40 and 41 join. The check valve 68 has grooves on either of its sides which match the ridge where guide tubes 40 and 41 join. This provides a rail or channel along which the check valve 68 can be lowered and raised into position. In this embodiment, the pipe level 138 unit is shown as in FIG. 7. This configuration of the invention also has a first direction tool guide 158 and a second direction tool guide 160. These form a lip which deflects a cleanout tool in either the first direction or the second direction, and causes it to go either towards the house or towards the city. As in the previous embodiment, the check valve 68 seats against a check valve seat 74, and may be lowered or raised along the channel 174 formed by the interior ridges of the figure of eight shape of the pipe. There is also a check valve rod 70 for lowering and raising the check valve 68.

Figure 9:
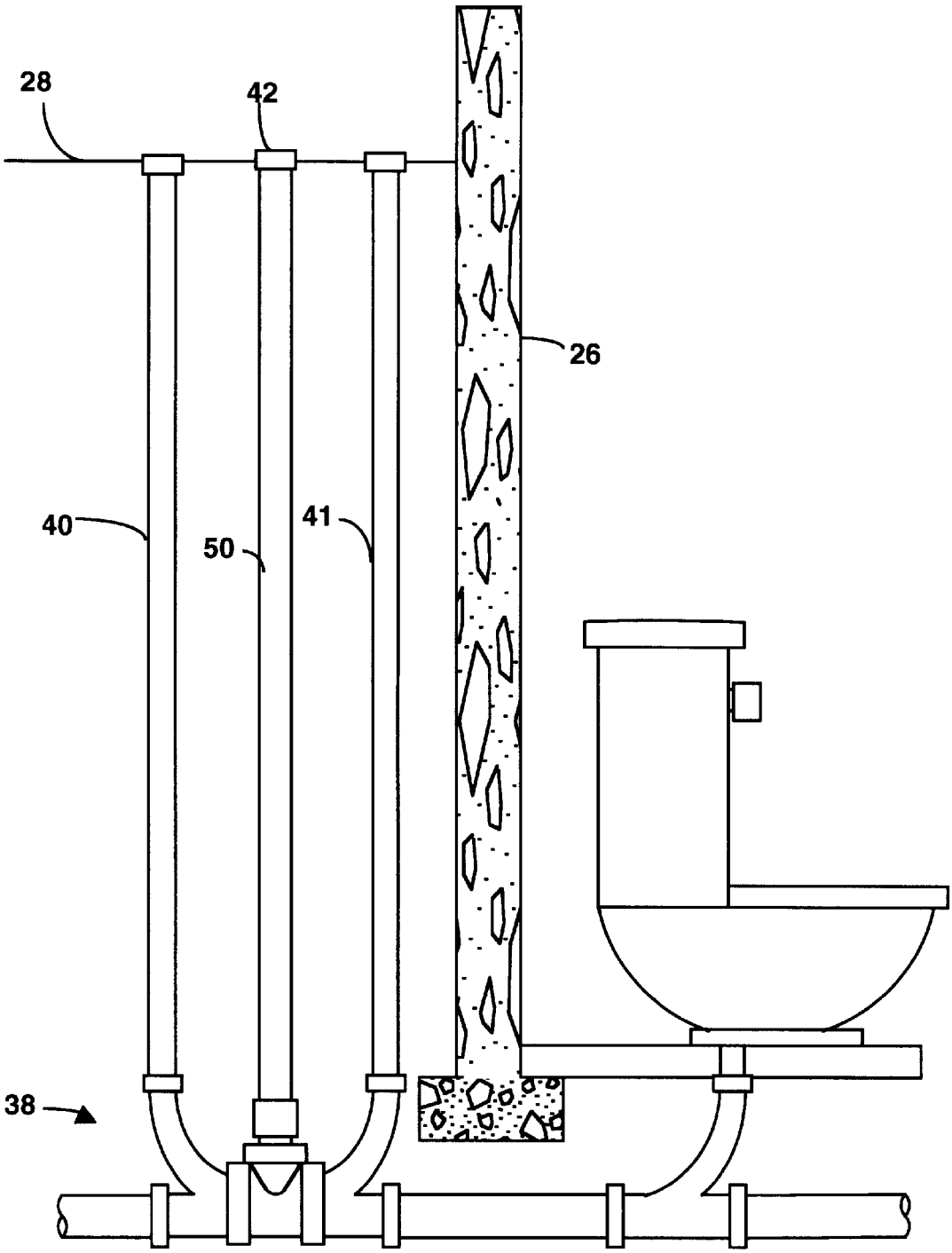
FIG. 9 is a view of one version of the invention with three ground level access points.

Another configuration of the invention is shown in FIG. 9. This configuration of the invention includes a pipe level unit 38, which is connected to three tubes which extend to the ground level. These three tubes are the check valve access tube 50, the first tool guide 40 and the second tool guide 41. This device operates in exactly the same way as shown in FIG. 3, but rather than having one access point at ground level, this configuration has three access points at ground level.

Figure 10:
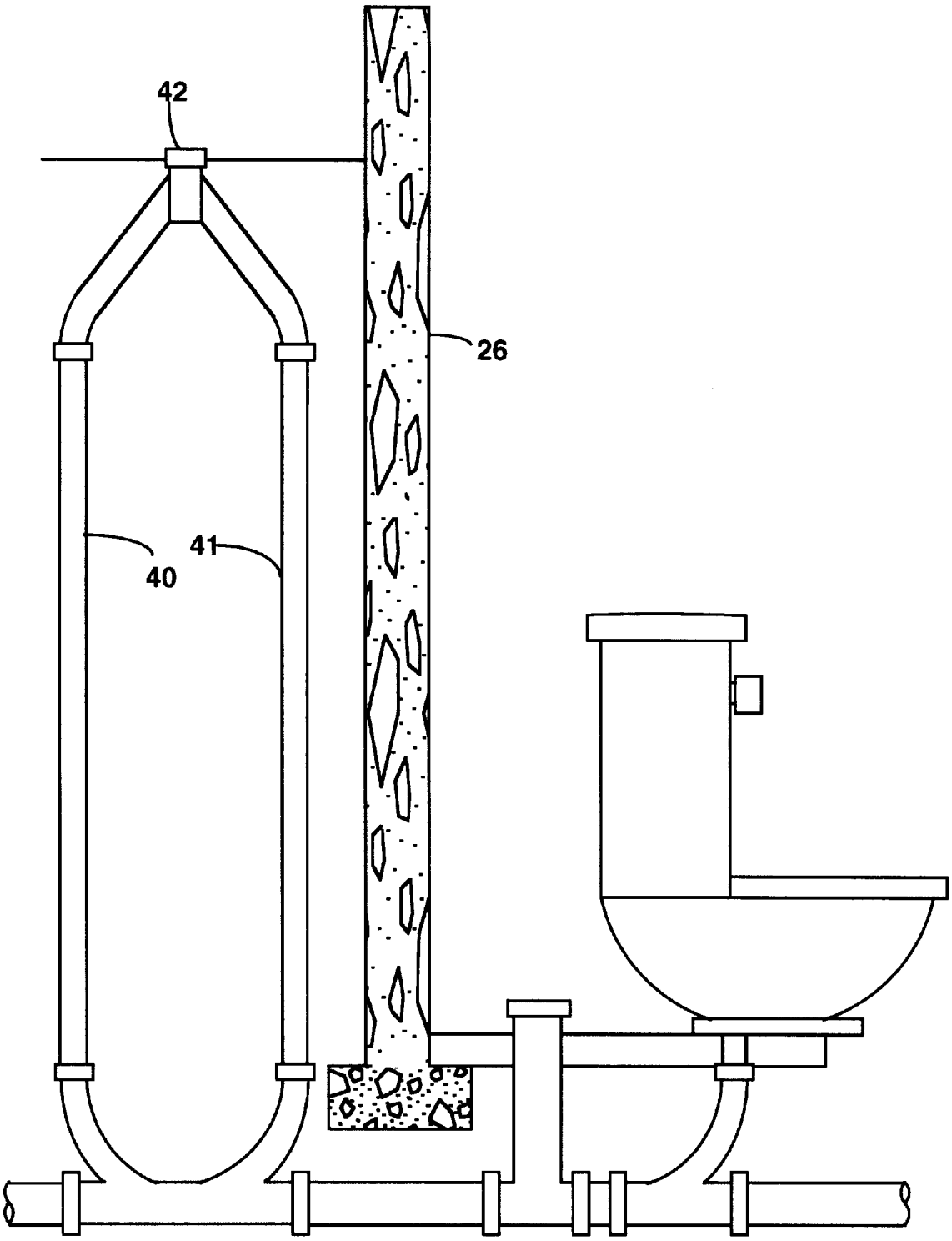
FIG. 10 is a view of a version of the invention with no check valve. the ground level unit and the pipe level unit are assembled from smaller component pieces.

Another preferred configuration is shown in FIG. 10. In this configuration, the device is a bi-directional cleanout, but does not include a built-in backflow preventer. In this configuration, the backflow preventer is installed as a separate unit which may be inside the house as in current installations.

Figure 11:
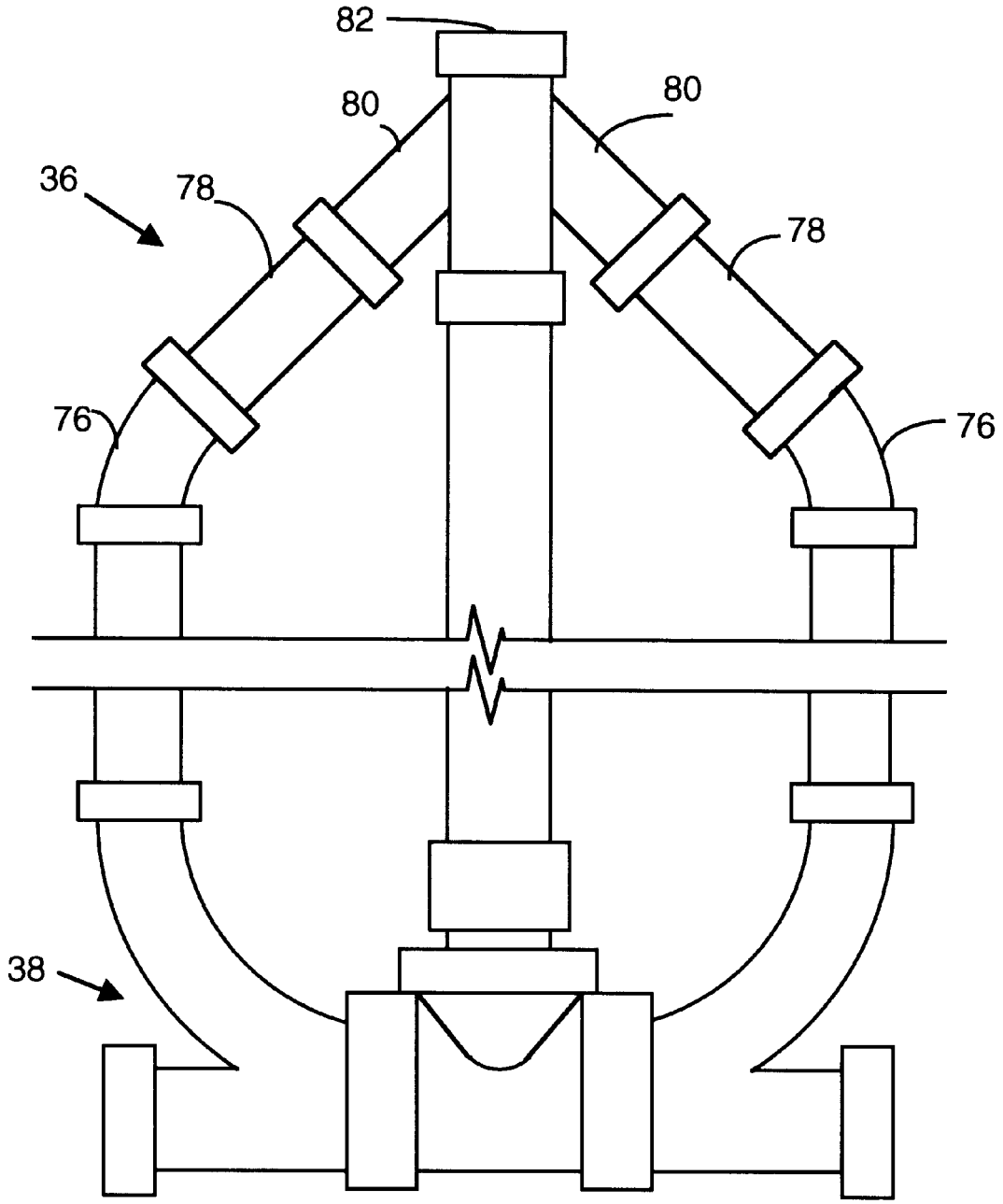
FIG. 11 is a view of a version of the invention in which the ground level unit and the pipe level unit are assembled from smaller component pieces.

FIG. 11 shows another preferred embodiment of the invention. This embodiment is similar to that shown in FIG. 3. In this embodiment, the ground level unit 36 is formed from a number of individual components rather than being formed as one piece. These components include 45° elbows 76, two straight sections of pipe 78, a three-way pipe section 80, and a cap 82.

Embodiment of the invention, it is to be distinctly understood that this invention is not limited thereto but may be variously embodied to practice within the scope of the following claims.

From the foregoing description, it will be apparent that various changes may be made without departing from the spirit and scope of the invention as defined by the following claims.

I claim:

1. A bi-directional cleanout unit for use in a pipeline with a first end and a second end, comprising:

a generally tubular first guide tube, which extends from grade level for attachment to a pipe level unit, with said first guide tube for insertion of a cleanout tool;

a generally tubular second guide tube, which extends from grade level for attachment to a pipe level unit, with said second guide tube for insertion of a cleanout tool, generally tubular backflow prevention valve device access tube, which extends from grade level for attachment to a pipe level unit, and which is disposed intermediate between said first guide tube said second guide tube, for a backflow prevention valve device and which includes a means of inserting and removing said backflow prevention valve device therefrom;

a pipe level unit, which comprises;

a first direction tool guide, which attaches at one end to said first guide tube, and at another end to said pipe level unit, and which directs a cleanout tool into said pipeline towards said first end of said pipeline;

a second direction tool guide, which attaches at one end to said second guide tube, and at another end to said pipe level unit, and which directs a cleanout tool into said pipeline towards said second end of said pipeline; and wherein said first direction tool guide directs said cleanout tool into said pipeline across a path disposed between said first and second direction tool guide for cleaning across said path in one direction, and said second direction tool guide directs said cleanout tool into said pipeline across said path disposed between said first and second direction tool guide for cleaning across said path in an opposite direction, upon removal through said backflow prevention valve device access tube of said backflow prevention valve device from said pipe level unit, thereby selectively providing cleanout of said pipeline in opposite direction, with no uncleaned area associated with said pipeline path within said pipe level unit.

2. The bi-directional cleanout unit of claim 1 in which said backflow prevention device is a removable check valve.

3. The bi-directional cleanout unit of claim 2 which further includes a means of guiding said check valve in said check valve access tube, and for removing said check valve.

4. The bi-directional cleanout unit of claim 3 in which the means of removing said backflow check valve is a check valve guide ridge formed in a figure of eight cross section tube.

5. The bi-directional cleanout unit of claim 3 in which said means of guiding said check valve in said check valve access tube is a pair of channels in said check valve access, tube along which said check valve can slide.

6. The bi-directional cleanout unit of claim 4 in which said means of guiding said check valve in said check valve access tube is a pair of rails in said check valve access tube, along which said check valve can slide.

7. The bi-directional cleanout unit of claim 4 in which said means of guiding said check valve in said check valve access tube is a pair of ridges in said check valve access tube, along which said check valve can slide.

8. The bi-directional cleanout unit of claim 2 which further includes a rod with a first and a second end, for removing said check valve, which is attached to said check valve at a first end, and which extends to ground level at a second end.

9. The bi-directional cleanout unit of claim 4 in which said two guide tubes and said check valve access tube comprise three vertical tubes which terminate at ground level with three caps.

10. The bi-directional cleanout unit of claim 4 which further comprises a ground level unit in which said two guide tubes and said check valve access tube are terminated, and which has an access opening and a cap.

11. The bi-directional cleanout unit of claim 1 in which said two guide tubes are two generally vertical tubes.

12. The bi-directional cleanout unit of claim 1 in which said two guide tubes are formed of one tube with a figure of eight cross sectional shape.

13. A pipeline bi-directional cleanout unit with built-in backflow check valve, for use in a pipeline with a first end and a second end, comprising a ground level unit with a top and a bottom side, which is comprised of an access opening on said top side, and which includes a first and second guide tube selector, and a check valve access tube connector, in which a clean-out tool may be inserted into either said first or said second guide tube selector, and if inserted in said first guide tube selector is directed toward the first end of said pipeline, and if inserted in said second guide tube selector is directed toward the second end of the pipeline, and which also includes a check valve access tube connection through which a check valve may be removed or installed;

a pair of guide tubes which have a first end and a second end, and which connect to said guide tube selectors at said first ends, and which connect at said second end to said tool guides of said pipe level unit;

a check valve access tube with a first end a second end, which connects at said first end to said check valve access tube connection, and at second end with a check valve access tube receiver of a pipe level unit, and which includes check valve guide means, for insertion of said check valve into a working position in said pipe level unit, or for removal of said check valve through said check valve access tube, said pipe level unit comprising a clean out pipe section with a first direction tool guide and a second direction tool guide, each of which connects with said second ends of said guide tubes, and which guides a cleanout tool in a selected direction in said pipe, a check valve seat, for interfitting relationship with said check valve in a working position, and said check valve access tube connection, for connecting to said check valve access tube;

said check valve interfiting in a working position in said pipe level unit, which admits fluid flow from one direction, but which blocks fluid flow from an opposite direction, and which is attached to a check valve rod, and which interacts with said check valve guide means, said check valve rod having with a first end and a second end, which attaches at said first end with said check valve, with said second end accessible for permitting insertion and or removal of said check valve, and which extends or retracts said check valve from said ground level unit to a working position in a pipe level unit; wherein said tool guides direct a cleanout tool along intersecting paths in said pipeline, so that all areas of the pipeline are traversed by said cleanout tool.

14. The pipeline backflow check valve and bi-directional cleanout unit of claim 13 in which said ground level unit is formed of two 45 degree elbows, two straight pipe sections, a three way fitting, and a cap.

15. A bi-directional cleanout unit for use with a cleanout tool and in a pipeline with a first end and a second end, comprising;

a grade level unit which provides a single grade level access point for insertion of a cleanout tool into said bi-directional cleanout unit;

a generally tubular first guide tube, which attaches at an angle to said grade level unit, and which extends from said grade level unit in a vertical direction for attachment to a pipe level unit, with said first guide tube for insertion of a cleanout tool;

a generally tubular second guide tube, which attaches at an angle to said grade level unit, and which extends from said grade level unit in a vertical direction for attachment to a pipe level unit, with said second guide tube for insertion of said cleanout tool;

a pipe level unit, which comprises;

a first direction tool guide, which attaches at one end to said first guide tube, and at another end to said pipe level unit, which directs a cleanout tool into said pipeline towards said first end of said pipeline; and a second direction tool guide, which attaches at one end to said second guide tube, and at another end to said pipe level unit, and which directs a cleanout tool into said pipeline towards said second end of said pipeline; wherein said first direction tool guide directs said cleanout tool into said pipeline across a path disposed between said first and second direction tool guides for cleaning across said path in one direction, and said second direction tool guide directs said cleanout tool into said pipeline across said path disposed between said first and second direction tool guides for cleaning across said path in an opposite direction, thereby selectively providing cleanout of said pipeline in opposite directions, with no uncleaned area associated with said pipeline path within said pipe level unit.

* * * * *